US005960748A

United States Patent [19]

Lewis

[11] Patent Number: 5,960,748

[45] Date of Patent: Oct. 5, 1999

[54] VEHICLE HYDRAULIC COMPONENT SUPPORT AND COOLING SYSTEM

[75] Inventor: J. Gordon Lewis, Bloomfield Hills, Mich.

[73] Assignee: Valeo, Inc., Auburn Hills, Mich.

[21] Appl. No.: 08/850,559

[22] Filed: May 2, 1997

[51] Int. Cl.[6] ..... F01P 7/02

[52] U.S. Cl. ..... 123/41.12; 123/41.49

[58] Field of Search ..... 123/41.49, 41.12

[56] References Cited

U.S. PATENT DOCUMENTS

| | | | |
|---|---|---|---|
| 1,277,735 | 9/1918 | La Porte | 123/41.49 |
| 1,491,554 | 4/1924 | Seidle | 123/41.49 |
| 2,777,287 | 1/1957 | Tweedale | 60/12 |
| 3,220,640 | 11/1965 | Kambs | 230/270 |
| 3,659,567 | 5/1972 | Murray | 123/41.12 |
| 3,934,644 | 1/1976 | Johnston | 165/51 |
| 4,062,329 | 12/1977 | Rio | 123/41.12 |
| 4,066,047 | 1/1978 | Vidakovic et al. | 123/41.12 |
| 4,181,172 | 1/1980 | Longhouse | 165/51 |
| 4,189,919 | 2/1980 | Goscenski, Jr | 123/41.12 |
| 4,223,646 | 9/1980 | Kinder | 123/41.11 |
| 4,329,946 | 5/1982 | Longhouse | 123/41.49 |
| 4,366,783 | 1/1983 | Clemente | 123/41.12 |
| 4,371,318 | 2/1983 | Kime | 417/304 |
| 4,461,246 | 7/1984 | Clemente | 123/41.12 |
| 4,489,680 | 12/1984 | Spokas et al. | 123/41.05 |
| 4,685,513 | 8/1987 | Longhouse et al. | 165/121 |
| 4,691,668 | 9/1987 | West | 123/41.49 |
| 4,738,330 | 4/1988 | Suzuki et al. | 123/41.12 |
| 4,836,148 | 6/1989 | Savage et al. | 124/41.49 |
| 4,969,421 | 11/1990 | Haner et al. | 123/41.49 |
| 5,002,019 | 3/1991 | Klaucke et al. | 123/41.19 |
| 5,216,983 | 6/1993 | Nilson | 123/41.12 |
| 5,522,457 | 6/1996 | Lenz | 165/121 |
| 5,566,954 | 10/1996 | Hahn | 277/184 |

FOREIGN PATENT DOCUMENTS

| | | | |
|---|---|---|---|
| 1118880 | 6/1956 | France | 123/41.49 |
| 198311 | 12/1982 | Japan | 123/41.19 |

*Primary Examiner*—John Kwon
*Attorney, Agent, or Firm*—J. Gordon Lewis

[57] ABSTRACT

A hydraulic cooling system and method for use in a vehicle comprises a hydraulic pump which is coupled to a hydraulic motor for driving a fan blade in operative relationship with a radiator via a hydraulic conduit. The hydraulic conduit is formed and provided to not only hydraulically couple the hydraulic pump to the hydraulic motor, but also to define a support structure for supporting the hydraulic motor in operative relationship with the radiator, without the need for additional support brackets or structure. It is envisioned that the hydraulic conduit could be pre-formed in a general pyramidal or frusto-conical shape to absorb forces exerted by the motor and so that it can easily be assembled and-mounted to the fan shroud. The hydraulic conduit is also formed such that it becomes situated in a heat exchange chamber between the fan shroud and the radiator when the conduit is mounted on the shroud and may comprise a plurality of fins to facilitate cooling the hydraulic fluid traveling through the hydraulic conduit. A logic and priority valve may be coupled to the hydraulic conduit and responsive to an electronic control unit to control the flow directed to the fan motor in order to maximize cooling efficiency.

83 Claims, 3 Drawing Sheets

VEHICLE HYDRAULIC COMPONENT SUPPORT AND COOLING SYSTEM

BACKGROUND OF THE INVENTION

1. Field of the Invention

This invention pertains to a cooling system for internal combustion engines cooled by a radiator, and more particularly, to a system and method for providing a conduit which not only couples a hydraulic pump to a hydraulic component, but also provides a support structure for supporting the hydraulic component at a predetermined position with respect to the radiator, minimizing or eliminating the need for additional support brackets.

2. Brief Description of the Related Art

For years, fans have been used to draw air through a radiator of an internal combustion engine for the purpose of lowering the temperature of the engine coolant. Initially, such fans were directly powered by the engines and, often, belt systems were employed. With the advent of front wheel drive, vehicles used cross-mounted engines and radiator coolant fans have often been powered by electric motors. Even in some engines having crank shafts which extend parallel to the length of the vehicle, electric motors have been used to drive the radiator cooling fan in view of the versatility of installation and ease of location with such system components to accommodate themselves to the aerodynamic configuration and other space limitations of the vehicle.

While internal engine cooling fans driven by electric motors are suitable in many light duty installations, electric motors are not suitable for powering fans under heavy duty requirements as the size of the electric motor must be significantly increased as compared to lighter duty installations and the electric drain on the vehicle electric system is enormous. Further, larger electric motors are very expensive and their size defeats the advantages obtained with smaller electric motors. Typical electric drive systems for permitting the engine to transfer a required amount of power to a fan are shown in U.S. Pat. Nos. 2,777,287; 3,220,640; 3,659,567; 3,934,644; 4,062,329; 4,066,047; 4,223,646; 4,461,246; 4,489,680; and 5,216,983.

Another advantage of using a hydraulically powered fan is that they typically are very quiet which can be aesthetically pleasing to the vehicle's operator.

One of the problems with using hydraulic and electronic fan motors is that the shrouds had to be provided with brackets which were affixed or integrally molded to the shroud assembly such that when the motor was mounted directly to the brackets, it would cause the fan blade to be properly positioned and centered in the shroud. U.S. Pat. No. 5,216,983 issued to Nilson illustrates this approach. A number of problems arise with the approach of Nilson. First, the fan shroud must have the brackets molded or mounted thereto. Also, the hydraulic conduit is not integrally coupled to or molded into the fan shroud, which can make accurately mounting the motor somewhat tedious.

Another problem with the cooling system designs of the past is illustrated in FIG. 6 wherein a radiator A had a structural support B secured or welded thereto for holding the fan motor C such that the fan blade D was held in operative relationship with the radiator A. As illustrated in FIG. 1 of the Nilson reference, this bracket may be affixed at an outer end to an end of a shroud. As illustrated in FIG. 6, one problem with such a design is the working depth (indicated by double arrow E in FIG. 6) required. Because of the reduction of engine compartment space, there is a need to reduce the space consumed by the motor and radiator arrangement.

Notice also that as the motor in FIG. 6 is energized to pull air through the radiator and toward the engine, the motor is forced in an axial direction towards the radiator. Because the hydraulic conduits to and from the Nilson motor are situated substantially parallel to a plane in which the radiator lies, it is believed that an undesirable loading, such as a shear or bending force, may cause the conduits to bend, leak or break at various points, such as where the conduits are coupled to the motor or require the addition of substantial structural elements capable of transmitting the motor load forces.

What is needed, therefore, is a system and method for providing a hydraulic coupling between the hydraulic components in a vehicle which will not only couple the hydraulic components, but which will provide the sole means for supporting the hydraulic component in a predetermined position, without the need for excessive space or support brackets or engine couplings and which is designed and positioned to facilitate providing an effective cooling system and method for cooling the hydraulic fluid.

SUMMARY OF THE INVENTION

It is, therefore, a primary object of the invention to provide a system and method for hydraulically coupling a plurality of hydraulic components using a hydraulic conduit which also serves to support at least one of the plurality of components in a predetermined position on the vehicle.

Another object of the invention is to provide a system and method for providing a hydraulic conduit system which will not only support a hydraulic component in a predetermined position, but which will facilitate cooling the hydraulic fluid traveling through the hydraulic conduit.

Still another object of the invention is to provide a hydraulic conduit which can be preformed and coupled to a hydraulic motor such that it can quickly be mounted on, for example, a fan shroud, thereby reducing the amount of time required to assemble the hydraulic cooling system.

Still another object of the invention is to provide a system and method for hydraulically coupling a plurality of hydraulic components together using a hydraulic conduit which is formed with a plurality of channels and a valve for facilitating controlling the speed of the motor.

A further object of the invention is to provide a cooling system design which distributes forces generated by the motor and which can be utilized in limited-space environments.

In one aspect, this invention comprises a hydraulic component support for supporting a hydraulic component at a predetermined position on a vehicle comprising at least one hydraulic conduit for providing a passageway for transferring hydraulic fluid to and from the hydraulic component, at least one hydraulic conduit being formed to also provide the sole support for supporting the hydraulic component at the predetermined position.

In another aspect, this invention comprises a hydraulic cooling system for use in a vehicle comprising a hydraulic pump, a radiator, a hydraulic motor for driving a fan blade and a hydraulic conduit for hydraulically coupling the hydraulic pump and the hydraulic motor together, the hydraulic conduit also defining a support structure for supporting the hydraulic motor in operative relationship with the radiator, without the need for additional support brackets.

In another aspect, this invention comprises a method for supporting a component on a motor vehicle, the method comprising the steps of forming a hydraulic conduit to define a support for supporting the component at a predetermined position on the motor vehicle, thereby eliminating the need for additional support brackets.

In still another aspect, this invention comprises a method for delivering hydraulic fluid between a hydraulic pump and a hydraulic component in a vehicle comprising the steps of hydraulically coupling the hydraulic pump to the hydraulic component using a hydraulic conduit and forming the hydraulic conduit to define a self-contained support structure capable of supporting either the hydraulic pump or the hydraulic component in a first predetermined position or a second predetermined position, respectively.

In still another aspect, this invention comprises a hydraulic conduit for supporting a hydraulic component at a predetermined position on a vehicle comprising at least one conduit member for transporting hydraulic fluid to and from the hydraulic component, at least one conduit member also defining a support structure for supporting the hydraulic component at the predetermined position, without using additional support brackets.

In yet another aspect, this invention comprises a hydraulic cooling network for use on a motor vehicle comprising a hydraulic pump for supplying hydraulic pressure, a hydraulic fan motor for performing work in response to the hydraulic pressure and conduit means for conducting hydraulic fluid between the hydraulic pump and the hydraulic fan motor, the conduit means defining a self-sufficient support structure for supporting the hydraulic component in a predetermined position in the vehicle.

Other objects and advantages of the invention will be apparent from the following description, the accompanying drawings, and the appended claims.

BRIEF DESCRIPTION OF THE ACCOMPANYING DRAWINGS

DETAILED DESCRIPTION OF THE PREFERRED EMBODIMENTS

Figure 1:
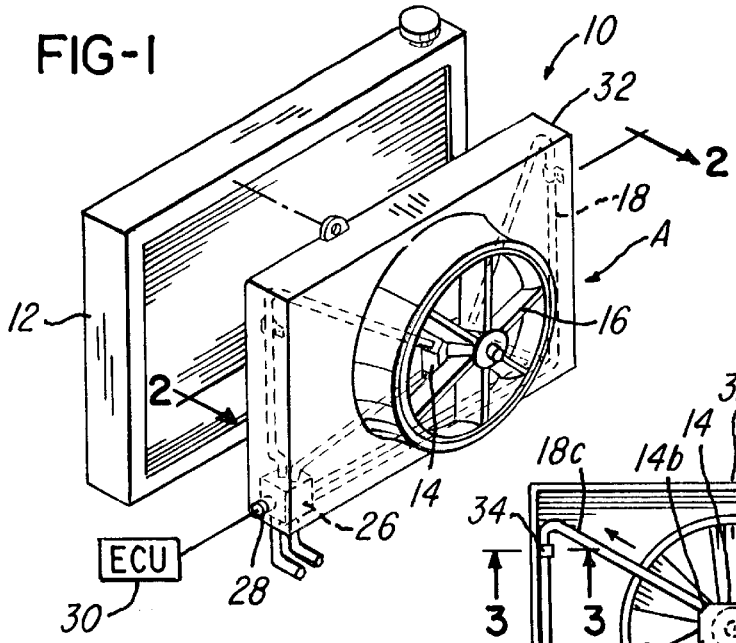
FIG. 1 is an exploded view of a hydraulic cooling system in accordance with one embodiment of the invention.
Figure 4:
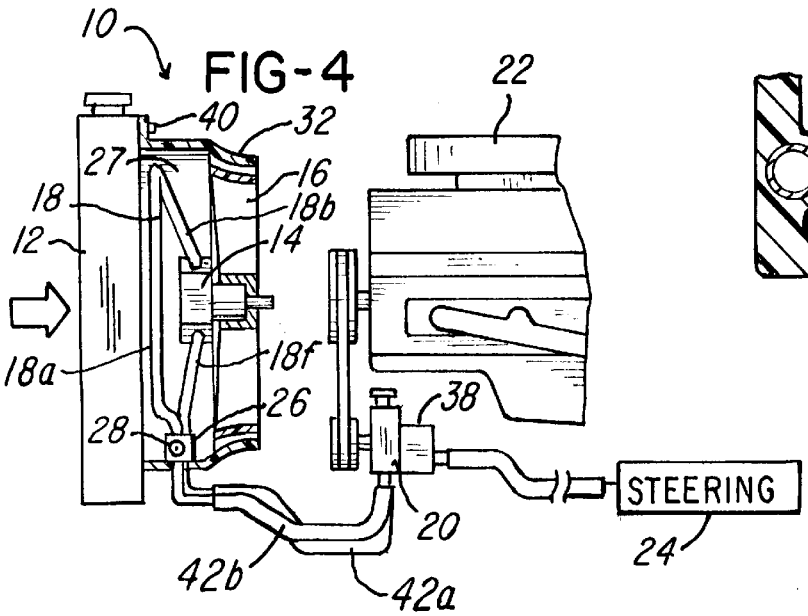
FIG. 4 is a partial sectional view illustrating the position of the hydraulic conduit in a heat exchange chamber.

Referring now to FIG. 1 a hydraulic cooling system 10 for use in a vehicle (not shown) is shown. The hydraulic cooling system 10 comprises a radiator 12, a hydraulic motor 14 for driving a fan blade 16 and a hydraulic conduit 18 for hydraulically coupling the hydraulic motor 14 to a hydraulic pump 20 (FIG. 4). In the embodiment being described, the hydraulic pump 20 is driven by an engine 22 of the vehicle (not shown) which, in turn, hydraulically powers a plurality of hydraulic components, such as hydraulic motor 14 and a hydraulic steering system 24 (FIG. 4) or other components, such as a hydraulic alternator or a hydraulic reservoir (not shown).

Notice that the hydraulic conduit 18 is formed to define a support structure for supporting the hydraulic motor 14 in operative relationship with the radiator 12 in an air-flow path in a heat exchange chamber 27 (FIG. 4) to facilitate cooling of the hydraulic fluid in the hydraulic conduit 18. In this embodiment, the hydraulic conduit could be formed of any suitable materials, such as aluminum or metal.

Figure 2:
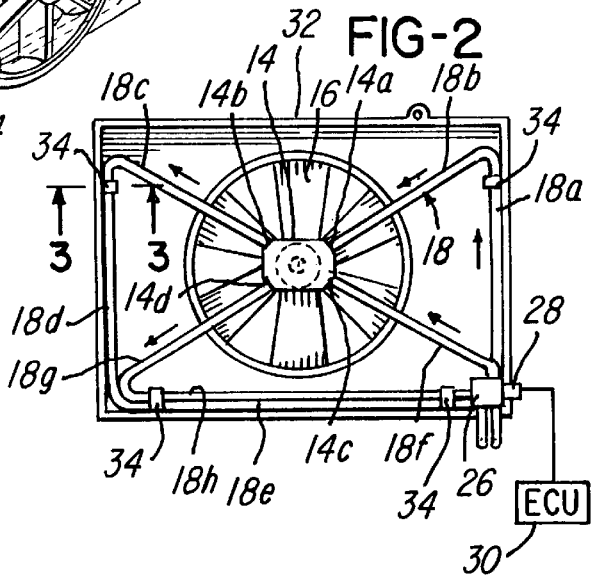
FIG. 2 is a view taken along the line 2—2 in FIG. 1 showing a hydraulic conduit mounted to a fan shroud of the hydraulic cooling system shown in FIG. 1.

The cooling system 10 further comprises valve means or a valve system 26 which, in the embodiment being described, is a three-way valve 26 comprising a solenoid 28 coupled to an electronic control unit ("ECU") 30 resident in a computer system (not shown) on the vehicle. As best illustrated in FIG. 2, the ECU 30 may energize solenoid 28 to actuate the three-way valve system 26 to control the flow from the three-way valve system 26 through either a high pressure hydraulic path (defined by conduit legs, legs 18*a* and 18*b* into motor inlet 14*a* through motor outlet 14*b* and into legs 18*c*, 18*d* and 18*e*) or a low pressure hydraulic path (defined by leg 18*f* to inlet 14*c*, from outlet 14*d* through legs 18*g* and 18*h*).

It should be appreciated that the three-way valve 26 could comprise any suitable number and arrangement of valves that permit selective control and direction of fluid flow in and out of conduit 18. This feature may be necessary in order to control, for example, the speed of fan blade 16 or to bypass the fan altogether to divert or prioritize hydraulic fluid to another part of the automotive system, such as a hydraulic steering system (not shown).

Thus, it should be appreciated that the conduit legs 18*a*–18*h* in combination with the three-way valve system 26 and ECU 30 provide a multi-speed hydraulic control system for hydraulically energizing hydraulic motor 14 and also for controlling its speed of operation. Although not shown, the hydraulic conduit 18 could be formed or provided with fewer or more conduit legs 18*a*–18*h* in order to achieve a desired design shape and flow as may be required to hydraulically support the hydraulic components.

Figure 3:
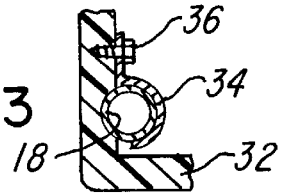
FIG. 3 is a fragmentary sectional view taken along the line 3—3 in FIG. 2, showing a tab which may be used to couple the hydraulic conduit to the fan shroud.
Figure 5:
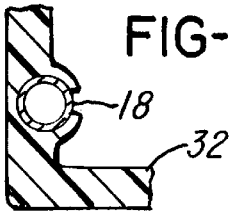
FIG. 5 is a fragmentary sectional view showing at least a portion of the hydraulic conduit insert-molded into the fan shroud.

In the embodiment being illustrated in FIGS. 1–5, hydraulic conduit 18 is formed to provide a support structure for supporting the hydraulic motor 14 and its associated fan blade 16 on the fan shroud 32, without the need for additional brackets to support, for example, the hydraulic motor 14. In this regard and as illustrated in FIG. 3, fan shroud 32 may be provided with a plurality of mounting tabs 34 which are secured to the fan shroud 32 via a suitable fastener, such as screw 36, thereby securing the hydraulic conduit 18 onto fan shroud 32. Alternatively, it is envisioned that the hydraulic conduit 18 may be insert-molded directly into the fan shroud 32 as illustrated in FIG. 5. Still another approach envisioned is to provide cooperating, spaced apart and opposed molded tabs (not shown) at periodic intervals on the fan shroud 32 which receives the hydraulic conduit 18 so that the hydraulic conduit 18 can simply be "snapped" into place.

Figure 6:
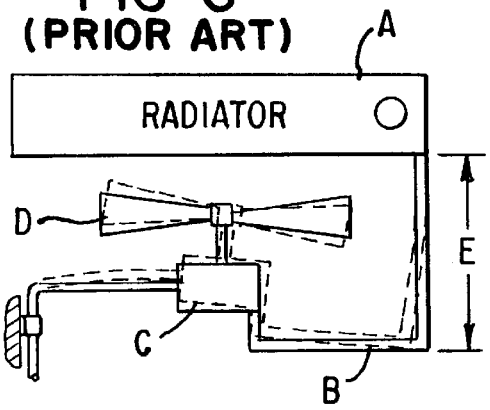
FIG-6 (PRIOR ART)
FIG. 6 is a view of a prior art cooling system showing the working depth E required by the prior art cooling system.
Figure 7:
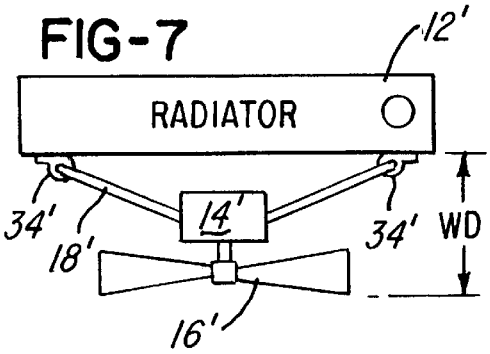
FIG. 7 is a plan view of another embodiment of the invention showing the hydraulic conduit mounted directly to the radiator.
Figure 11:
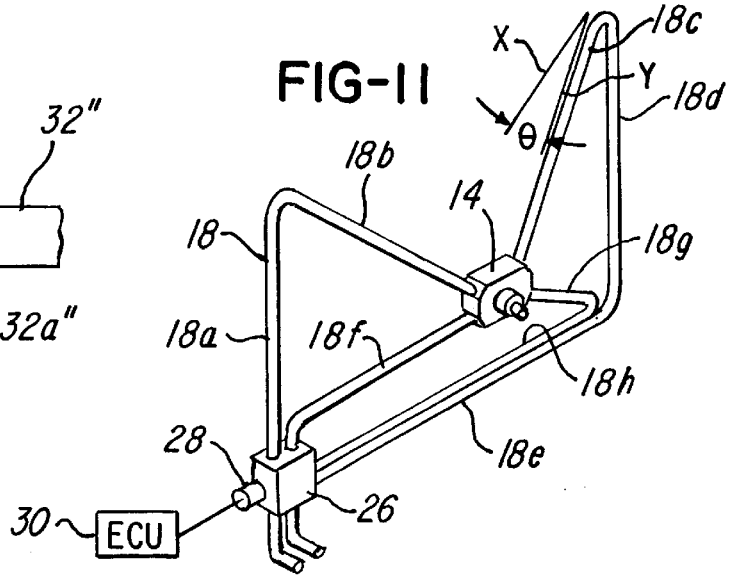
FIG. 11 is a perspective view of the hydraulic conduit of FIGS. 1–5, showing the legs 18*b*, 18*c*, 18*g* and 18*g* lying in a frusto-conical, or pyramidal plane.

As best illustrated in FIG. 11, notice that the hydraulic conduit 18 is configured to define a shape which may be viewed as being generally pyramidal or frusto-conical. In this regard, notice that legs 18*a* and 18*d* lie in a first plane which for ease of illustration is identified by line X in FIG. 11. Notice also that leg 18*c*, for example, lies in a plane which is parallel to line Y in FIG. 11. These lines X and Y define an angle θ which defines the slope or steepness of the pyramidal or frusto-conical shape. Advantageously, when the motor 14 is energized the conduit legs 18*b*, 18*c*, 18*g* and 18*f* are capable of receiving a substantially compressive or tensile force or load applied by motor 14 as the fan blade 16 pulls or pushes, respectively, air through the radiator 12 and forces motor 14 toward radiator 12. This facilitates distributing the load generated by the fan blade 16 to the radiator 12, for example, of the vehicle. This also facilitates avoiding movement and bending of the type shown in FIG. 6.

It should be appreciated that while the hydraulic conduit 18 is illustrated as supporting the hydraulic motor 14 and fan blade 16 in operative relationship with the radiator 12, it could be formed to provide a support (for a second hydraulic load, such as an alternator (not shown), heat exchanger or cooler (not shown) and the like without the need for additional support brackets.

Moreover, a pressure sensor (not shown) could be placed in-line, for example, in leg 18*a* and coupled to ECU 30 in order to sense a pressure or a change in pressure therein. This, in turn, facilitates detecting a leak or blockage in the leg 18*a*, thereby enabling a leak or blockage to be quickly isolated, without interrupting the operation of, for example, the hydraulic motor 14. This feature also facilitates making repairs to the hydraulic conduit 18 quicker and easier.

In the embodiment being described, the cooling system 10 further comprises a logic and priority valve 38 (FIG. 4) coupled to the ECU 30 (FIG. 1) for controlling and prioritizing flow between hydraulic steering system 24 and hydraulic motor 14 as desired. In this regard, the teachings of U.S. patent application Ser. No. 08/779,769, filed Jan. 7, 1997, by inventors Jeffrey J. Buschur and Robert V. Eyink, entitled Fluid Control System for Powering Vehicle Accessories and U.S. Pat. No. 5,535,845, which are both assigned to the same Assignee of the present invention and which are incorporated herein by reference and made a part hereof, may be utilized to facilitate directing fluid flow and prioritization of the hydraulic steering system 24 over the hydraulic motor 14.

The hydraulic conduit 18 may be manufactured from a conventional aluminum tubing and may comprise a plurality of fins integrally formed or secured thereto (for example, by welding) in order to facilitate heat exchange and cooling. A method for delivering hydraulic fluid between the hydraulic pump 20 and the hydraulic motor 14 and for supporting the hydraulic motor 14 in operative relationship with the radiator 12 will now be described.

The method begins by securing the aforementioned hydraulic conduit 18 to the radiator 12. The hydraulic conduit 18 may be provided in a pre-formed arrangement to define a support structure for facilitating supporting the hydraulic pump 20 in a predetermined position, such as position A in FIG. 1, so that the hydraulic motor 14 and fan blade 16 become operatively aligned with radiator 12, and the radiator 12 may then be placed in the vehicle. The hydraulic conduit 18 may then be coupled to the hydraulic pump 20 so that the hydraulic motor 14 and hydraulic pump 20 are in fluid communication via flexible hoses 42*a* and 42*b*. It should be appreciated that various supplemental brackets or supporting members may be used with the various features of this invention.

In the manner described earlier herein, the method for supporting may also comprise the steps of fastening the hydraulic conduit 18 onto the fan shroud 32 using a plurality of the mounting tabs 34 and screws 36. Alternatively, the method may comprise the step of insert-molding the hydraulic conduit 18 directly into the fan shroud 32 (FIG. 5). Although not shown, it should be appreciated that some combination of the aforementioned methods for securing the hydraulic conduit 18 to the fan shroud 32 may also be utilized.

After the hydraulic conduit 18 is secured to fan shroud 32, the fan shroud 32 is secured to the radiator 12.

Advantageously, this system and method provide means for forming and defining a support structure for supporting a hydraulic component at a predetermined position in a vehicle without the need for additional support brackets. Although not shown, it is also envisioned that the hydraulic conduit 18 could be formed to provide a support for supporting a plurality of components as mentioned earlier herein. For example, a hydraulic reservoir or cooler (not shown) could be supported by one or more of the legs 18*a*–18*h* (FIG. 2) so that the cooler is situated in the heat exchange chamber 27 (FIG. 4) to facilitate cooling the hydraulic fluid and improving the efficiency of the hydraulic cooler.

Alternatively, the hydraulic cooler could be integral with either the fan shroud 32 or the radiator 12 in which case the hydraulic conduit 18 may be formed to not only support the hydraulic motor 14 at the predetermined position A (FIG. 1), but also to provide a hydraulic conduit 18 to hydraulically couple the hydraulic motor 14, hydraulic pump 20, and cooler (not shown) together.

Thus, a significant feature of the present invention is that it provides a method, means and apparatus for forming a support for simultaneously supporting at least one hydraulic component at a predetermined position, as well as providing a hydraulic conduit system for hydraulically coupling the hydraulic components as desired, without the need to couple additional brackets or support structure to the hydraulic components.

Advantageously, this system and method provides means for providing a pre-formed conduit which can be coupled to hydraulic motor 14 so that it can be readily and easily assembled to the fan shroud 32. This, in turn, facilitates reducing the amount of time required to assemble the cooling system 10.

FIGS. 7–10 illustrate other embodiments hydraulic cooling system 10. In these embodiments, similar parts are identified with identical part numbers with the exception of a "'", "''", or "'''" being added to the identical part number. Thus, notice with respect to the embodiment shown in FIG. 7 that the hydraulic conduit 18' is coupled directly to the radiator 12' using the mounting tabs 34' which are identical to the mounting tabs 34 illustrated in FIG. 3. Notice that a working distance, identified by double arrow WD, is substantially reduced when compared to the distance E of the prior art cooling system illustrated in FIG. 6. Advantageously, this arrangement of components is particularly suitable for use in engine compartments where space is tight.

Figure 8:
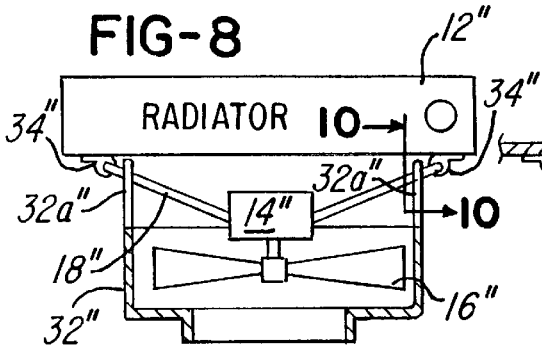
FIG. 8 is a plan view of still another embodiment of the invention showing the hydraulic conduit mounted directly to the radiator, with a shroud mounted directly to the hydraulic conduit.
Figure 10:
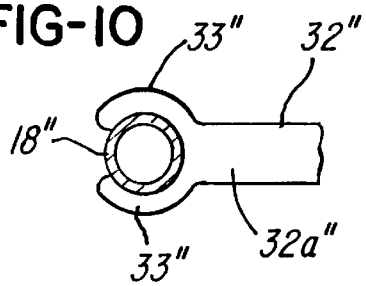
FIG. 10 is a fragmentary view showing an end of a shroud mounted directly to the hydraulic conduit.

FIG. 8 illustrates yet another embodiment of the invention where the shroud 32" is mounted directly to and supported by the hydraulic conduit 18", rather than by the radiator 12" as in the embodiment illustrated in FIGS. 1–5. As illustrated in FIG. 10, the shroud 32" comprises ends 32*a*" (FIG. 8 and 10) having "snap-on" clips 33" which are resilient to permit the end 32*a*" to be snapped directly onto the hydraulic conduit 18".

Figure 9:
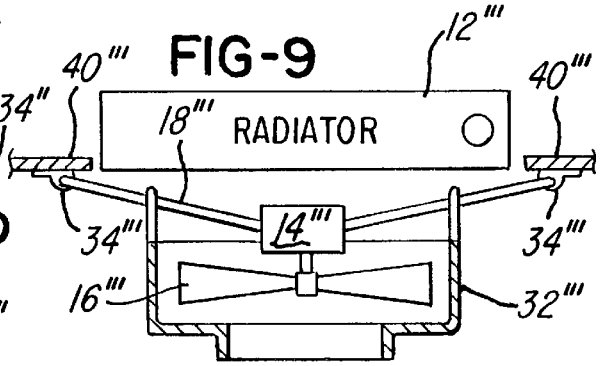
FIG. 9 is a plan view of yet another embodiment of the invention showing the hydraulic conduit mounted directly to a front end of a vehicle.

FIG. 9 illustrates another embodiment similar to the embodiment shown and described in FIGS. 8 and 10, except that the hydraulic conduit 18'" is mounted directly to a front end 40'" of a vehicle (not shown). This arrangement facilitates separating the hydraulic conduit 18'" and associated shroud 32'" from the radiator 12'". This further enables, for example, the radiator 12'" to be situated separately from the shroud 32'" as may be desired. Thus, it should be appreciated, that the fan motor 14'" could be mounted in operative relationship with engine 22 by mounting the conduit 18'" directly to the vehicle. The radiator 12'" could be situated at a location other than in the front of the engine compartment or remotely at some location other than the engine compartment (such as toward the rear of the vehicle).

Figure 12:
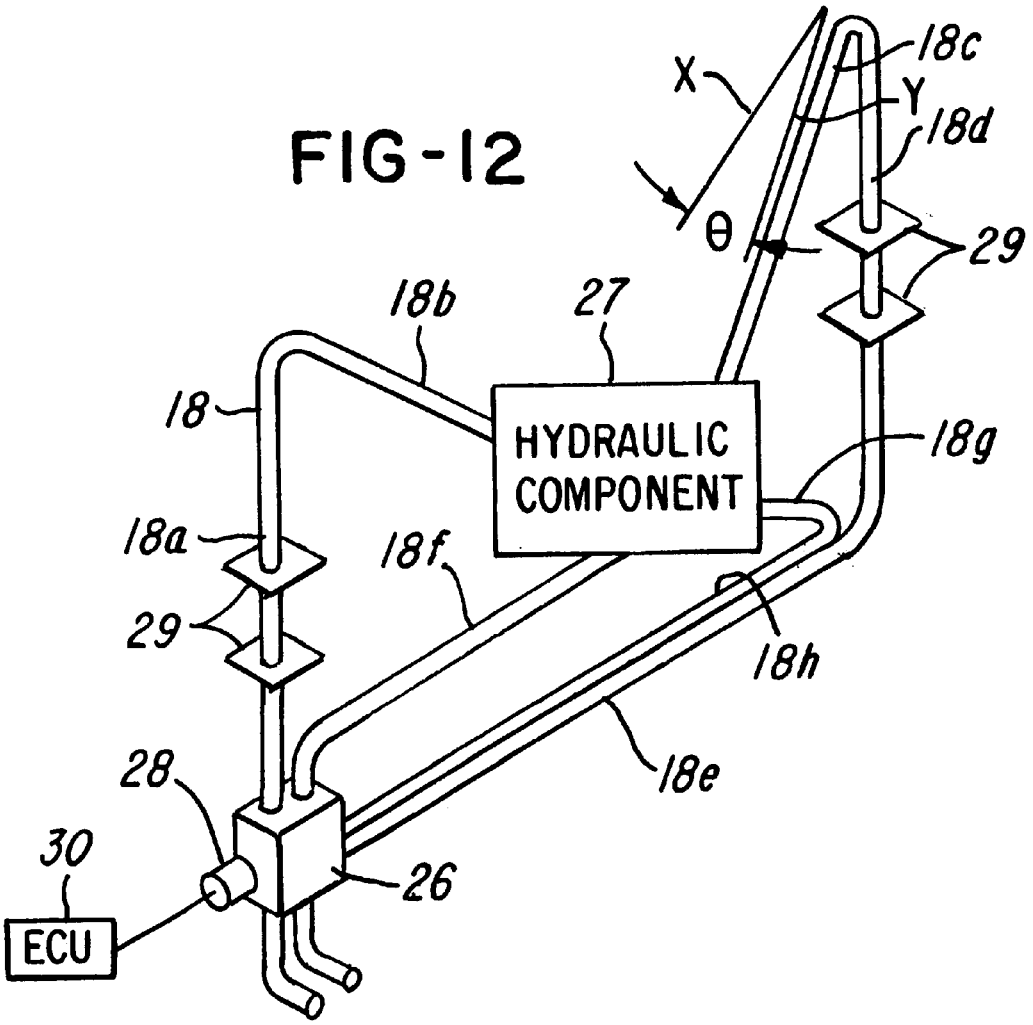
FIG. 12 is a perspective schematic view of the hydraulic conduit supporting a hydraulic component, such as a hydraulic fan motor, a hydraulic steering pump, a hydraulic alternator or a hydraulic reservoir.

FIG. 12 is similar to the embodiment shown in FIG. 11, with the same parts bearing the same part numbers. Notice in FIG. 12 that the hydraulic conduit 18 is configured to define a shape which may be viewed as being generally pyramidal or frusto-conical. In this regard, notice that legs 18*a* and 18*d* lie in a first plane which for ease of illustration is identified by line X in FIG. 11. Notice also that leg 18*c*, for example, lies in a plane which is parallel to line Y in FIG. 12. These lines X and Y define an angle theta which defines the slope or steepness of the pyramidal or frusto-conical shape. Notice that the conduit 18 is formed to another hydraulic component which is shown schematically as part 27 and may comprise any one of the following: a hydraulic fan motor, a hydraulic steering pump, a hydraulic alternator or a hydraulic reservoir.

As described earlier herein relative to the illustration in FIG. 11, when the hydraulic component comprises the motor 14 which drives the fan blade 16, the load generated by the fan blade 16 is distributed to the radiator 12, for example, of the vehicle. Notice also a plurality of fins 29 may be situated on one or more of the legs 18*a*–18*g* of the hydraulic conduit 18 to facilitate cooling the hydraulic fluid therein.

While the system and methods herein described, and the forms of apparatus for carrying these methods into effect, constitute preferred embodiments of this invention, it is to be understood that the invention is not limited to these precise methods and forms of apparatus, and that changes may be made in either without departing from the scope of the invention, which is defined in the appended claims.

What is claimed is:

1. A hydraulic component support for supporting a hydraulic component at a predetermined position on a vehicle comprising:

at least three hydraulic conduits for providing a passageway for transferring hydraulic fluid required by said hydraulic component;

said at least three hydraulic conduits being elongated and formed to support hydraulic component at said predetermined position to equally distributed load and avoid bending of said one or more of at least three conduits.

2. The hydraulic component support as recited in claim 1 wherein said hydraulic component comprises one of the following: a hydraulic fan motor, a hydraulic steering pump, a hydraulic alternator, a hydraulic reservoir.

3. The hydraulic component support as recited in claim 1 wherein said predetermined position is adjacent to a radiator.

4. The hydraulic component support as recited in claim 1 wherein said at least one of said at least three hydraulic conduits are coupled to a radiator.

5. The hydraulic component support as recited in claim 1 wherein said at least one of said at least three hydraulic conduits comprise at least a portion of which is insert-molded into a shroud associated with a radiator on the vehicle.

6. The hydraulic component support as recited in claim 1 wherein said at least one of said at least three hydraulic conduits comprises a plurality of fins secured thereto to facilitate heat exchange.

7. The hydraulic component support as recited in claim 1 wherein said at least one of said at least three hydraulic conduits are arranged to support a plurality of hydraulic components.

8. The hydraulic component support as recited in claim 1 wherein said motor is a hydraulic fan motor, said at least three hydraulic conduits are coupled directly to said hydraulic fan motor to transfer hydraulic fluid towards and away from said hydraulic fan motor and being formed to support the hydraulic fan motor in operative relationship with a radiator in the vehicle.

9. The hydraulic component support as recited in claim 8 wherein said at least one of said at least three conduits is secured directly to said radiator.

10. The hydraulic component support as recited in claim 8 wherein a portion of at least one of said at least three conduits insert-molded into said radiator.

11. The hydraulic component support as recited in claim 8 wherein said least one of said at least three conduits comprises a plurality of fine secured thereto.

12. The hydraulic component support as recited in claim 1 wherein said at least one of said at least three hydraulic conduits is formed to withstand a compressive force applied by said hydraulic component.

13. The hydraulic component support as recited in claim 1 wherein said at least one of said at least three hydraulic conduits comprises a plurality of conduit legs which lie in a substantially conical or pyramidal plane.

14. The hydraulic component support as recited in claim 1 wherein said at least one of said at least three hydraulic conduits is coupled directly to a vehicle.

15. The hydraulic component support as recited in claim 1 wherein a shroud is coupled directly to at least one of said at least three hydraulic conduits.

16. The hydraulic component support as recited in claim 1 wherein a shroud is coupled directly to at least one of said at least three hydraulic conduits.

17. A hydraulic cooling system for use in a vehicle comprising:

a hydraulic pump;

a radiator;

a hydraulic motor driving a fan blade; and a hydraulic conduit for hydraulically coupling said hydraulic pump and said hydraulic motor together;

said hydraulic conduit being elongated and defining at least three legs for distributing a load and to avoid bending of at least one of said at least three legs generated by said fan blade to a structure on which the hydraulic conduit is mounted.

18. The hydraulic cooling fan system as recited in claim 17 wherein said hydraulic conduit comprises a plurality of legs coupled to said hydraulic motor for providing a plurality of inlets and a plurality of outlets to and from said hydraulic motor.

19. The hydraulic cooling fan system as recited in claim 17 wherein a portion of said hydraulic conduit is insert-molded into said radiator.

20. The hydraulic cooling fan system as recited in claim 17 wherein said system comprises a second hydraulic component, said hydraulic conduit being formed to support both said hydraulic motor and said second hydraulic component while hydraulically coupling said hydraulic motor and said second hydraulic component to said hydraulic pump.

21. The hydraulic cooling fan system as recited in claim 17 wherein said hydraulic conduit defines a plurality of hydraulic legs for supporting said hydraulic motor on said radiator.

22. The hydraulic cooling system as recited in claim 17 wherein said hydraulic conduit defines a motor support comprising at least four conduit legs, said at least four conduit legs being capable of transporting hydraulic fluid either towards or away from said hydraulic motor.

23. The hydraulic cooling fan system as recited in claim 17 wherein said hydraulic conduit defines a network defining a plurality of fluid paths, said system further comprising a hydraulic switch for selecting one or more of said plurality of fluid paths.

24. The hydraulic cooling system as recited in claim 17 wherein said system further comprises a second hydraulic load;

said hydraulic conduit further defining a second hydraulic support for supporting said second hydraulic load in a predetermined position.

25. The hydraulic cooling system as recited in claim 17 wherein said second hydraulic load comprises at least one of the following: a fan motor, an alternator, or a hydraulic reservoir.

26. The hydraulic cooling system as recited in claim 17 wherein said system further comprises a plurality of brackets for mounting said hydraulic conduit to said radiator.

27. The hydraulic cooling system as recited in claim 17 wherein said hydraulic conduit comprises a plurality of heat-exchange fins.

28. The hydraulic cooling system as recited in claim 17 wherein said system further comprises:

a hydraulic pump reservoir coupled to said hydraulic pump and integral with said radiator.

29. The hydraulic cooling system as recited in claim 17 wherein said system further comprises a hydraulic reservoir coupled to said hydraulic pump, wherein said hydraulic reservoir is situated remotely from said hydraulic pump.

30. The hydraulic cooling system as recited in claim 17 wherein said hydraulic conduit is formed to withstand a compressive force applied by said hydraulic component.

31. The hydraulic cooling system as recited in claim 17 wherein said hydraulic conduit comprises a plurality of conduit legs which lie in a substantially conical or pyramidal plane.

32. The hydraulic cooling system as recited in claim 17 wherein said conduit is coupled directly to a vehicle.

33. The hydraulic cooling system as recited in claim 17 wherein a shroud is coupled directly to said at least one hydraulic conduit.

34. The hydraulic cooling system as recited in claim 17 wherein a shroud is coupled directly to said at least one hydraulic conduit.

35. A method for supporting a component on a motor vehicle, said method comprising the steps of:

forming a hydraulic conduit comprising at least three legs to define support for supporting the component at a predetermined position on the motor vehicle, thereby mitigating the need for additional support brackets;

said conduit being shaped to distribute load forces generated by the component to the motor vehicle and to avoid bending of said at least three legs.

36. The method as recited in claim 35 wherein said component comprises a hydraulic component, said method further comprising the step of:

securing said hydraulic conduit to said vehicle such that said hydraulic component becomes situated in said predetermined position.

37. The method as recited in claim 35 wherein said motor vehicle comprises a radiator, said component comprising a hydraulic fan motor, said method further comprising the step of:

forming said hydraulic conduit to support the hydraulic fan motor in operative relationship with said radiator while being capable of transporting hydraulic fluid between a hydraulic pump and said hydraulic fan motor.

38. The method as recited in claim 37 wherein said method further comprises the step of:

fastening said hydraulic conduit directly to said radiator.

39. The method as recited in claim 37 wherein said method further comprises the step of:

insert-molding at least a portion of said hydraulic conduit into a shroud associated with said radiator.

40. The method as recited in claim 35 wherein said method further comprises the step of:

forming said hydraulic conduit to define a support for supporting a plurality of components on the motor vehicle.

41. The method as recited in claim 40 wherein said method further comprises the step of:

forming said hydraulic conduit to define a support for supporting a plurality of hydraulic components, said plurality of hydraulic components comprising a hydraulic fan motor and at least one of the following: a hydraulic alternator, a hydraulic cooler, a hydraulic steering pump.

42. The method as recited in claim 37 wherein said method further comprises the step of:

situating a plurality of fins on said hydraulic conduit to facilitate cooling hydraulic fluid passing through the hydraulic conduit.

43. The method as recited in claim 35 wherein said method further comprises the step of:

forming said support for simultaneously supporting and hydraulically coupling a hydraulic fan motor to a hydraulic pump, said support comprising a plurality of legs each of said plurality of legs having one end coupled to said hydraulic fan motor and being configured to cause said hydraulic fan motor to be positioned in operative relationship with a radiator on the motor vehicle.

44. The method as recited in claim 43 wherein said method further comprises the steps of:

coupling a hydraulic switch to said hydraulic conduit and between said hydraulic fan motor and said hydraulic pump;

actuating said hydraulic switch to control the speed of said hydraulic fan motor.

45. A method for delivering hydraulic fluid between a hydraulic pump and a hydraulic component in a vehicle comprising the steps of:

hydraulically coupling said hydraulic pump to said hydraulic component using a hydraulic conduit comprising at least three and forming said hydraulic conduit to define a self-contained support structure capable of supporting either said hydraulic pump or said hydraulic component in a first predetermined position or a second predetermined position, respectively; said support structure also facilitating avoiding bending of said at least three legs.

46. The method as recited in claim 45 wherein said hydraulic component comprises a hydraulic fan motor, said method further comprising the step of:

forming said hydraulic conduit to define a support structure capable of supporting said hydraulic fan motor in operative relationship with a radiator situated on the vehicle.

47. The method as recited in claim 45 wherein said vehicle comprises a radiator comprising an air flow path, said method further comprising the step of:

forming said hydraulic conduit to define a support structure having at least a portion of which is situated in said air flow path.

48. The method as recited in claim 45 wherein said hydraulic component comprises a hydraulic fan motor, said method further comprising the step of:

fastening said support structure to a fan shroud such that said hydraulic fan motor becomes positioned in a predetermined location relative to a radiator on the vehicle.

49. The method as recited in claim 45 wherein said hydraulic component comprises a hydraulic fan motor, said method further comprising the step of:

insert molding at least a portion of said support structure to a fan shroud such that said hydraulic fan motor becomes positioned in a predetermined location relative to a radiator on the vehicle.

50. The method as recited in claim 45 wherein said method further comprises the step of:

forming said support structure to support at least one other hydraulic component in addition to said hydraulic fan motor; said at least one other hydraulic component comprising at least one of the following: a hydraulic alternator, a hydraulic cooler, or a hydraulic steering pump.

51. The method as recited in claim 50 wherein said method further comprises the step of:

situating a plurality of fins on at least at least three legs to facilitate cooling hydraulic fluid passing therethrough.

52. The method as recited in claim 45 wherein said method further comprising the step of:

cooling said hydraulic fluid by passing said hydraulic fluid through a hydraulic pump reservoir integrally formed as part of said radiator.

53. The method as recited in claim 45 wherein said method further comprises the step of:

situating a hydraulic reservoir remotely from said hydraulic pump.

54. The method as recited in claim 45 wherein said method further comprises the step of:

forming said hydraulic conduit to receive a compressive force from said hydraulic pump.

55. The method as recited in claim 45 wherein said forming step further comprises the step of:

forming said hydraulic conduit to comprise a plurality of conduit legs which lie in a substantially conical or pyramidal plane.

56. The method as recited in claim 45 wherein said method further comprises the step of:

mounting said self-contained support structure directly onto a vehicle.

57. The method as recited in claim 45 wherein said method further comprises the steps of:

mounting a shroud,directly onto at least one of said at least three legs.

58. The method as recited in claim 45 wherein said method further comprises the step of:

mounting a shroud directly onto said self-contained support structure.

59. A hydraulic conduit for supporting a hydraulic component at a predetermined position on a vehicle comprising:

at least three conduit members for transporting hydraulic fluid to and from the hydraulic component; said at least three conduit members also defining a support structure for supporting the hydraulic component at said predetermined position; said support structure facilitating distributing load and avoiding bending of said at least three legs.

60. The hydraulic conduit as recited in claim 59 wherein said hydraulic component comprises one of the following: a hydraulic fan motor, a hydraulic steering pump, a hydraulic alternator or a hydraulic reservoir.

61. The hydraulic conduit as recited in claim 59 wherein said predetermined position is adjacent to a radiator.

62. The hydraulic conduit as recited in claim 59 wherein at lest one of said at least three hydraulic conduits is coupled to a radiator.

63. The hydraulic conduit as recited in claim 59 wherein at least one of said at least three hydraulic conduits comprises at least a portion which is insert-molded into a shroud associated with said hydraulic component.

64. The hydraulic conduit as recited in claim 59 wherein at least one of said at least three hydraulic conduits comprises a plurality of fins to facilitate heat exchange.

65. The hydraulic conduit as recited in claim 59 wherein at least one of said at least three hydraulic conduits is formed to support a plurality of hydraulic components.

66. The hydraulic conduit as recited in claim 59 wherein at least one of said at least three hydraulic components is a hydraulic fan motor, said at least one conduit being coupled directly to said hydraulic fan motor to transfer hydraulic fluid towards and away from said hydraulic fan motor and being formed to support the hydraulic fan motor in operative relationship with a radiator.

67. The hydraulic conduit as recited in claim 66 wherein at least one of said at least three conduits is secured directly to said radiator.

68. The hydraulic conduit as recited in claim 66 wherein a portion of at least one of said at least three conduits is insert-molded into said radiator.

69. The hydraulic conduit as recited in claim 66 wherein said at least one of said at least three conduits comprises a plurality of fins secured thereto.

70. A hydraulic cooling network for use on a motor vehicle comprising:

a hydraulic pump for supplying hydraulic pressure;

hydraulic fan motor for performing work in response to said hydraulic pressure; and conduit means comprising at least three conduit leas for conducting hydraulic fluid between said hydraulic pump and said hydraulic fan motor, said conduit means defining a self-sufficient support structure for supporting the hydraulic component in a predetermined position in said vehicle, said conduit means facilitating equally distributing load and avoiding bending of one or more of said at least three legs.

71. The hydraulic cooling network as recited in claim 70 wherein said predetermined position is adjacent to a radiator.

72. The hydraulic cooling network as recited in claim 70 wherein said conduit means is coupled directly to a radiator.

73. The hydraulic cooling network as recited in claim 70 wherein said conduit means comprises hydraulic tubing having at least a portion insert molded into a shroud associated with a radiator on situated on said vehicle.

74. The hydraulic cooling network as recited in claim 73 wherein said conduit means further comprises a plurality of fins situated on said hydraulic tubing.

75. The hydraulic cooling network as recited in claim 70 wherein said conduit means is formed to define a support structure for supporting a plurality of hydraulic components.

76. A hydraulic cooling system for use in a vehicle comprising:

a hydraulic pump;

a radiator;

a hydraulic motor for driving a fan blade; and a hydraulic conduit comprising at least three conduit legs for hydraulically coupling said hydraulic pump and said hydraulic motor together;

said hydraulic conduit being mounted on a conduit support and defining a support structure for supporting said hydraulic motor such that when said hydraulic motor is hydraulically energized, said support structure distributes any reaction force to the conduit support; said conduit means facilitating equally distributing load and avoiding bending of at least one of said at least three legs.

77. The hydraulic cooling system as recited in claim 76 wherein said conduit support is said radiator.

78. The hydraulic cooling system as recited in claim 76 wherein said conduit support is said vehicle.

79. The hydraulic cooling system as recited in claim 76 wherein said system further comprises a fan shroud mounted directly onto said radiator.

80. The hydraulic cooling system as recited in claim 76 wherein said system further comprises a fan shroud mounted directly onto said hydraulic conduit.

81. The hydraulic cooling system as recited in claim 76 wherein said support structure defines a plurality of conduit legs which lie in a substantially frusto-conical plane.

82. The hydraulic cooling system as recited in claim 76 wherein said conduit support is said radiator, said hydraulic conduit being mounted directly onto said radiator in order to support said fan blade in operative relationship with said radiator, without the need for additional brackets.

83. A hydraulic component support for supporting a hydraulic component at a predetermined position on a vehicle comprising:

support structure comprising;

at least first, second and third elongated, substantially rigid members interconnecting the hydraulic component to another;

at least one of said support members defining a conduit for conducting hydraulic fluid to or from said hydraulic component;

said support members simultaneously extending laterally and longitudinally with respect to an axis of symmetry of said component to distribute inertial forces of said hydraulic component and to avoid bending of one or more of said support members.

* * * * *